US010982423B1

(12) United States Patent
Sherwood

(10) Patent No.: US 10,982,423 B1
(45) **Date of Patent: *Apr. 20, 2021**

(54) SUMP SYSTEM

(71) Applicant: Robert Sherwood, Almont, MI (US)

(72) Inventor: Robert Sherwood, Almont, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/032,360

(22) Filed: Sep. 25, 2020

Related U.S. Application Data

(63) Continuation-in-part of application No. 16/816,924, filed on Mar. 12, 2020, which is a continuation-in-part of application No. 16/723,225, filed on Dec. 20, 2019, now Pat. No. 10,669,708.

(51) Int. Cl.

| | |
|---|---|
| ***E03F 1/00*** | (2006.01) |
| ***E03F 5/04*** | (2006.01) |
| ***E03F 5/10*** | (2006.01) |
| ***E03F 5/22*** | (2006.01) |

(52) U.S. Cl.
CPC ..... *E03F 1/00* (2013.01); *E03F 1/002* (2013.01); *E03F 5/0401* (2013.01); *E03F 5/101* (2013.01); *E03F 5/22* (2013.01)

(58) Field of Classification Search
CPC ..... E03F 1/00; E03F 1/002; E03F 5/04; E03F 5/0401; E03F 5/0404; E03F 5/10; E03F 5/101; E03F 5/22; E03F 7/00; E02B 11/00
USPC ..... 210/163, 164, 170.01, 170.03, 747.1, 210/747.2; 404/2, 4; 405/36, 42
See application file for complete search history.

(56) References Cited

U.S. PATENT DOCUMENTS

| | | | | |
|---|---|---|---|---|
| 1,327,211 | A | 1/1920 | Otterson | |
| 1,405,725 | A | 2/1922 | Snively | |
| 3,862,039 | A | 1/1975 | Summers | |
| 4,261,823 | A * | 4/1981 | Gallagher | E03F 5/101 210/164 |
| 4,824,287 | A | 4/1989 | Tracy | |
| 4,892,440 | A | 1/1990 | Regan | |
| 4,927,292 | A | 5/1990 | Justice | |
| 5,350,251 | A | 9/1994 | Daniel | |
| 8,561,633 | B2 | 10/2013 | Early et al. | |
| 10,669,708 | B1 | 6/2020 | Sherwood | |
| 2003/0021630 | A1 | 1/2003 | Norman et al. | |
| 2006/0278289 | A1 | 12/2006 | Robinson | |
| 2012/0160352 | A1 | 6/2012 | Humble | |

(Continued)

FOREIGN PATENT DOCUMENTS

| | | | |
|---|---|---|---|
| DE | 19726224 | C1 | 12/1998 |
| EP | 1997971 | A2 | 12/2008 |

*Primary Examiner* — Christopher Upton
(74) *Attorney, Agent, or Firm* — Brooks Kushman P.C.

(57) ABSTRACT

A sump system includes a catch basin and a sump pump. The catch basin is configured to receive runoff water. The catch basin defines a vertical chamber extending downward. The catch basin also defines a horizontal chamber intersecting the vertical chamber to form an intersecting region. The horizontal chamber extends outwardly in first and second horizontal directions from the vertical chamber such that the horizontal chamber forms first and second regions on first and second horizontal sides the intersecting region, respectively. The vertical chamber extends downward in a vertical direction from the horizontal chamber such that the vertical chamber forms a third region on a bottom side of the intersecting region. The sump pump is at least partially disposed within the third region.

20 Claims, 2 Drawing Sheets

(56) References Cited

U.S. PATENT DOCUMENTS

| | | | |
|---|---|---|---|
| 2014/0166129 | A1 | 6/2014 | Secrest et al. |
| 2014/0353225 | A1 | 12/2014 | Harvey |
| 2019/0177963 | A1 | 6/2019 | Brant |

* cited by examiner

SUMP SYSTEM

CROSS-REFERENCE TO RELATED APPLICATIONS

This application is a continuation-in-part of U.S. application Ser. No. 16/816,924 filed Mar. 12, 2020, which, in turn, is a continuation-in-part of U.S. patent application Ser. No. 16/723,225 filed on Dec. 20, 2019, now U.S. Pat. No. 10,669,708, the disclosures of which are hereby incorporated in their entirety by reference herein.

TECHNICAL FIELD

The present disclosure relates to sump systems that are configured to catch and store runoff water.

BACKGROUND

Runoff water may be directed to a catch basin of a sump system. The sump system may include a pump that is configured to pump water out of the catch basin once the water level within the catch basin rises to a certain level.

SUMMARY

A sump system includes a catch basin and a sump pump. The catch basin is configured to receive runoff water. The catch basin defines a vertical chamber extending downward in a vertical direction from an upper end to a lower end. The catch basin also defines a horizontal chamber intersecting the vertical chamber to form an intersecting region. The horizontal chamber extends outwardly in first and second opposing horizontal directions from an outer periphery of the vertical chamber such that the horizontal chamber forms first and second regions on opposing sides of the outer periphery of the vertical chamber. The vertical chamber extends outwardly in first and second opposing vertical directions from an outer periphery of the horizontal chamber such that the vertical chamber forms a third region between the upper end and a top side of the outer periphery of the horizontal chamber and such that the vertical chamber forms a fourth region between the lower end and a bottom side of the outer periphery of the horizontal chamber. The sump pump is at least partially disposed within the fourth region.

A sump system includes a catch basin and a sump pump. The catch basin is configured to receive runoff water. The catch basin defines a vertical chamber extending downward. The catch basin also defines a horizontal chamber intersecting the vertical chamber to form an intersecting region. The horizontal chamber extends outwardly in first and second horizontal directions from the vertical chamber such that the horizontal chamber forms first and second regions on first and second horizontal sides the intersecting region, respectively. The vertical chamber extends downward in a vertical direction from the horizontal chamber such that the vertical chamber forms a third region on a bottom side of the intersecting region. The sump pump is at least partially disposed within the third region.

A sump system includes a catch basin and a sump pump. The catch basin is configured to receive runoff water. The catch basin defines a horizontal chamber extending between first and second horizontal ends. The horizontal chamber has a ceiling and a first floor. The catch basin also defines a first vertical chamber intersecting the horizontal chamber between the first and second horizontal ends to form a first intersecting region. The first vertical chamber has a second floor that is disposed below the first floor. The catch basin also defines a second vertical chamber intersecting the horizontal chamber between the first and second horizontal ends to form a second intersecting region. The second vertical chamber is spaced apart from the first vertical chamber and has a third floor that is disposed below the first floor. The sump pump is disposed within the first vertical chamber at least partially between the first floor and the second floor.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
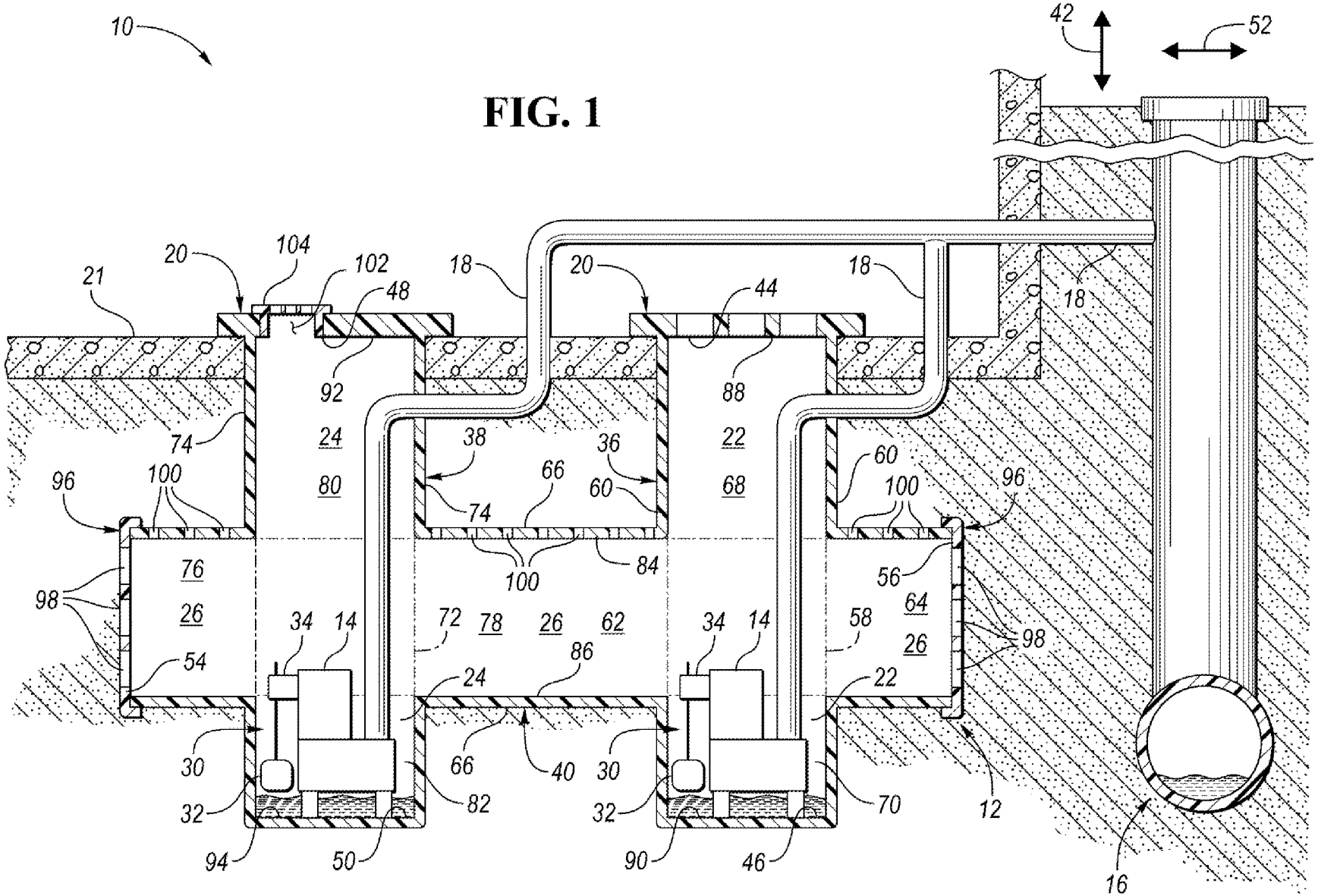
FIG. 1 is a front cross-sectional view of a sump system that includes a catch basin.
Figure 2:
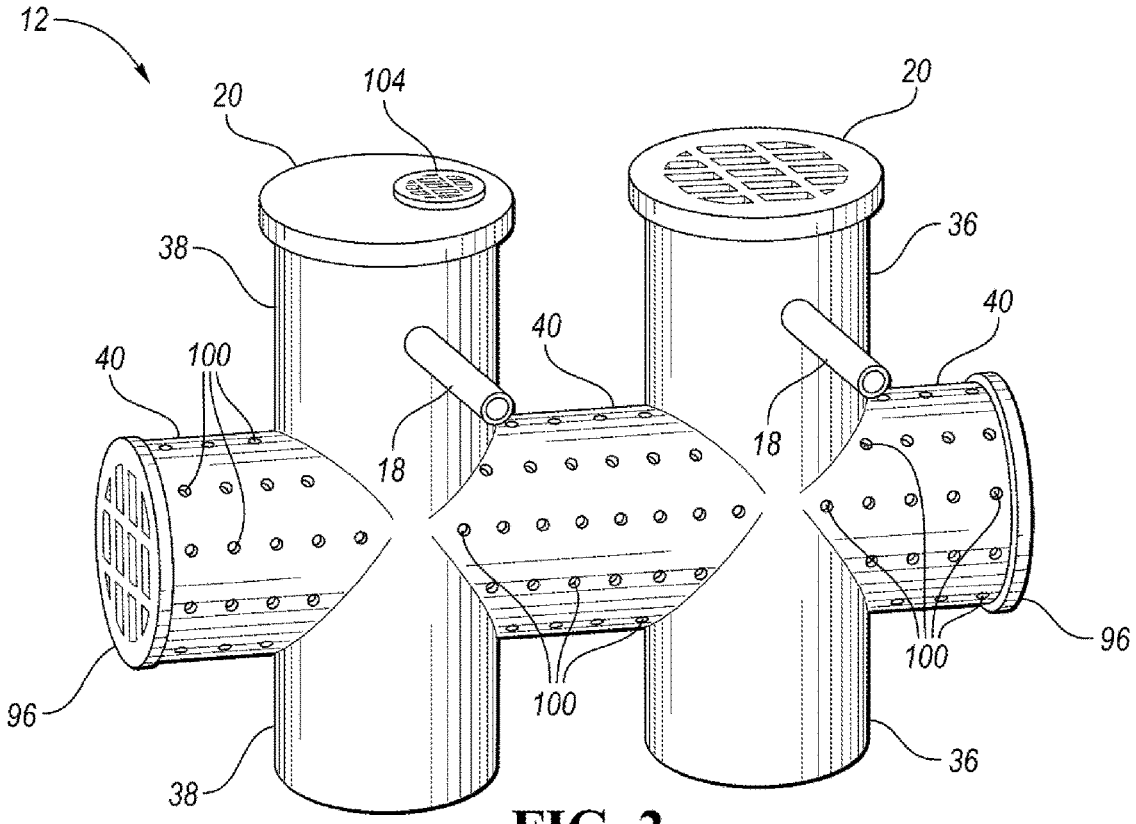
FIG. 2 is an isometric view of the catch basin.

Referring to FIGS. 1 and 2, a sump system 10 and a catch basin 12 for the sump system 10 are illustrated. The catch basin 12 defines a horizontal chamber and one or more vertical chambers. The catch basin 12 is configured to receive and store runoff water. The sump system 10 includes one or more sump pumps 14 that are configured to pump the runoff water out of the catch basin 12. The runoff water may be directed to a storm drain 16. The sump system 10 may be disposed within a building, as shown, or may be disposed in an outside area (i.e., not within a building). More specifically, the sump system 10 may be disposed below a lower level of a building (e.g., a basement) or at an elevation that is relatively low within an outside area so that gravity may direct runoff water to the catch basin 12.

The one or more pumps 14 may be connected to one or more outlet pipes 18 that direct the runoff water away from the catch basin 12. More specifically, the outlet pipes 18 may be in fluid communication with both the catch basin 12 and the storm drain 16, and may be configured to direct runoff water from the catch basin 12 to the storm drain 16. The outlet pipes 18 are shown to extend out of the catch basin 12 through the vertical chambers of the catch basin 12. It should be understood that the positioning of the outlet pipes 18 is for illustrative purposes only and that the outlet pipes 18 may be located at another position than illustrated. For example, the outlet pipes 18 may extend through lids or caps 20 that cover openings into the catch basin 12 or through the horizontal chamber of the catch basin 12. The caps 20 are shown to be disposed just above the ground level 21. However, it should be understood that the caps or lids may be disposed at or below the ground level 21.

The catch basin 12 may be connected to and in fluid communication with drains (not shown) via inlet pipes (not shown). The drains and inlet pipes may be part of a drainage system in a building or may be part of a drainage system for an outside area, such as a field that is being utilized for some purpose, such as a sporting event. The drains and inlet pipes may be configured to direct the runoff water into the catch basin 12. The inlet pipes may be connected to the vertical chambers or the horizontal chamber of the catch basin 12. It is noted that for illustrative purpose some of the components (e.g., the catch basin 12, a portion of storm drain 16, and the caps 20) are shown in cross-section while other components are not.

The one or more pumps 14 may be connected to a power source, such as a battery or a power grid. The electrical connections, such as electrical wires, plugs, or outlets that connect the pumps 14 to the power source are not shown for illustrative purposes. Each of the one or more pumps 14 includes a switching device 30 that is configured to switch the one or more pumps 14 between an "on state" and an "off state." In the on state, the one or more pumps 14 are configured to direct runoff water out of the catch basin 12. In the off state, runoff water may collect in the catch basin 12 since the one or more pumps 14 are turned off. The switching device 30 may be configured to activate a respective pump 14 to direct the runoff water out of the catch basin 12 once the water within the catch basin 12 reaches a threshold level. For example, the switching device may be a float 32 that is connected to an electrical switch 34 on each pump 14. When the water level raises within the catch basin 12 to at least the threshold level, the float 32 moves upward and turns on the switch to activate a respective pump 14. When the water level drops below the threshold level, the float 32 moves downward and turns off the switch to deactivate the respective pump 12. The switching device 30 may have a hysteresis so that the threshold level that activates the respective pump 14 is slightly higher than the threshold level that deactivates the respective pump 14.

The catch basin 12 defines a first vertical chamber 22, a second vertical chamber 24, and a horizontal chamber 26. The first vertical chamber 22, second vertical chamber 24, and horizontal chamber 26 may be defined within a first vertically ending tube 36, a second vertically ending tube 38, and a horizontally extending tube 40, respectively. The first vertical chamber 22 and the second vertical chamber 24 may be spaced apart from each other. The first vertical chamber 22 extends downward in a vertical direction 42 from a first upper end 44 to a first lower end 46. The up and down arrows of the vertical direction 42 may refer to opposing vertical directions. The second vertical chamber 24 extends downward in the vertical direction 42 from a second upper end 48 to a second lower end 50. The horizontal chamber 26 extends in a horizontal direction 52 from a first horizontal end 54 to a second horizontal end 56. The left and right arrows of the horizontal direction 52 may refer to opposing horizontal directions.

The horizontal chamber 26 and the first vertical chamber 22 intersect between the first horizontal end 54 and the second horizontal end 56 to form a first intersecting region 58. The horizontal chamber 26 extends outwardly in first and second opposing horizontal directions (e.g., the first and second arrows of the horizontal direction 52) from an outer periphery 60 of the first vertical chamber 22 such that the horizontal chamber 26 forms a first region 62 and a second region 64 on opposing sides of the outer periphery 60 of the first vertical chamber 22, respectively. It may also be stated that the horizontal chamber 26 extends outwardly in the first and second opposing horizontal directions from the first vertical chamber 22 such that the horizontal chamber 26 forms the first region 62 and the second region 64 on first and second opposing horizontal sides the first intersecting region 58.

The first vertical chamber 22 extends outwardly in first and second opposing vertical directions (e.g., the first and second arrows of the vertical direction 42) from an outer periphery 66 of the horizontal chamber 26 such that the first vertical chamber 22 forms a third region 68 between the first upper end 44 (or the cap 20) and a top side of the outer periphery 66 of the horizontal chamber 26, and such that the first vertical chamber 22 forms a fourth region 70 between the first lower end 46 and a bottom side of the outer periphery 66 of the horizontal chamber 26. It may also be stated that the first vertical chamber 22 extends upward in the vertical direction 42 from the horizontal chamber 26 (or from the first intersecting region 58) to the first upper end 44 (or to the cap 20) such that the first vertical chamber 22 forms the third region 68 on a top side of the first intersecting region 58. It may also be stated that the vertical chamber 22 extends downward in the vertical direction 42 from the horizontal chamber 26 such that the first vertical chamber 22 forms the fourth region 70 on a bottom side of the first intersecting region 58.

The horizontal chamber 26 and the second vertical chamber 24 intersect between the first horizontal end 54 and the second horizontal end 56 to form a second intersecting region 72. The horizontal chamber 26 extends outwardly in first and second opposing horizontal directions (e.g., the first and second arrows of the horizontal direction 52) from an outer periphery 74 of the second vertical chamber 24 such that the horizontal chamber 26 forms a fifth region 76 and a sixth region 78 on opposing sides of the outer periphery 74 of the second vertical chamber 24, respectively. The first region 62 and the sixth region 78 may be the same region, may be distinct separate regions, or may be separate regions that partially overlap. It may also be stated that the horizontal chamber 26 extends outwardly in the first and second opposing horizontal directions from the second vertical chamber 24 such that the horizontal chamber 26 forms the fifth region 76 and the sixth region 78 on first and second opposing horizontal sides the second intersecting region 72.

The second vertical chamber 24 extends outwardly in first and second opposing vertical directions (e.g., the first and second arrows of the vertical direction 42) from the outer periphery 66 of the horizontal chamber 26 such that the second vertical chamber 24 forms a seventh region 80 between the second upper end 48 (or the cap 20) and a top side of the outer periphery 66 of the horizontal chamber 26, and such that the second vertical chamber 24 forms an eighth region 82 between the second lower end 50 and a bottom side of the outer periphery 66 of the horizontal chamber 26. It may also be stated that the second vertical chamber 24 extends upward in the vertical direction 42 from the horizontal chamber 26 (or from the second intersecting region 72) to the second upper end 48 (or to the cap 20) such that the second vertical chamber 24 forms the seventh region 80 on a top side of the second intersecting region 72. It may also be stated that the second vertical chamber 24 extends downward in the vertical direction 42 from the horizontal chamber 26 such that the second vertical chamber 24 forms the eighth region 82 on a bottom side of the second intersecting region 72.

The horizontal chamber may have a first ceiling 84 and a first floor 86. The first vertical chamber 22 may have a second ceiling 88 and a second floor 90. The second vertical chamber 24 may have a third ceiling 92 and a third floor 94. The second ceiling 88 and the third ceiling 92 may be the bottom surfaces of the caps 20. The second ceiling 88 and the third ceiling 92 may be disposed above the first ceiling 84, The second floor 90 and the third floor 94 may be disposed below the first floor 86.

A first of the one or more pumps 14 may be disposed within the first vertical chamber 22. More specifically, the first of the one or more pumps 14 may be disposed at least partially within the fourth region 70. It may also be stated that the first of the one or more pumps 14 may be disposed within the first vertical chamber 22 at least partially between the first floor 86 and the second floor 90. A second of the one or more pumps 14 may be disposed within the second vertical chamber 24. More specifically, the second of the one or more pumps 14 may be disposed at least partially within the eighth region 82. It may also be stated that the second of the one or more pumps 14 may be disposed within the second vertical chamber 24 at least partially between the first floor 86 and the third floor 94.

Perforated caps 96 may be secured to each end of the horizontally extending tube 40. Alternatively, the caps 96 may not be perforated. The perforated caps 96 define orifices 98 that allow water to flow directly into and out of the horizontal chamber 26. The horizontally extending tube 40 of the catch basin 12 may also define a plurality of orifices 100 along the outer periphery 66 of the horizontal chamber 26 that establishes fluid communication between the horizontal chamber 26 and the exterior of the catch basin 12. Each of the plurality of orifices 100 also allow water to flow directly into and out of the horizontal chamber 26.

A first of the caps 20 may be secured to a top end of the first vertically ending tube 36 while a second the caps 20 may be secured to a top end of the second vertically ending tube 38. The caps 20 may be perforated similar to caps 96 (e.g., see cap 20 secured to the top end of the first vertically ending tube 36) or may not be perforated (i.e., the caps 20 may be solid structures that do not define orifices). Alternatively, the caps 20 may define a porthole 102. A lid 104 may be disposed within the porthole 102. The lid 104 may be perforated or may not be perforated. Either of caps 20 may have any of the configurations described herein and are not limited to the configurations illustrated in the Figures.

Figure 3:
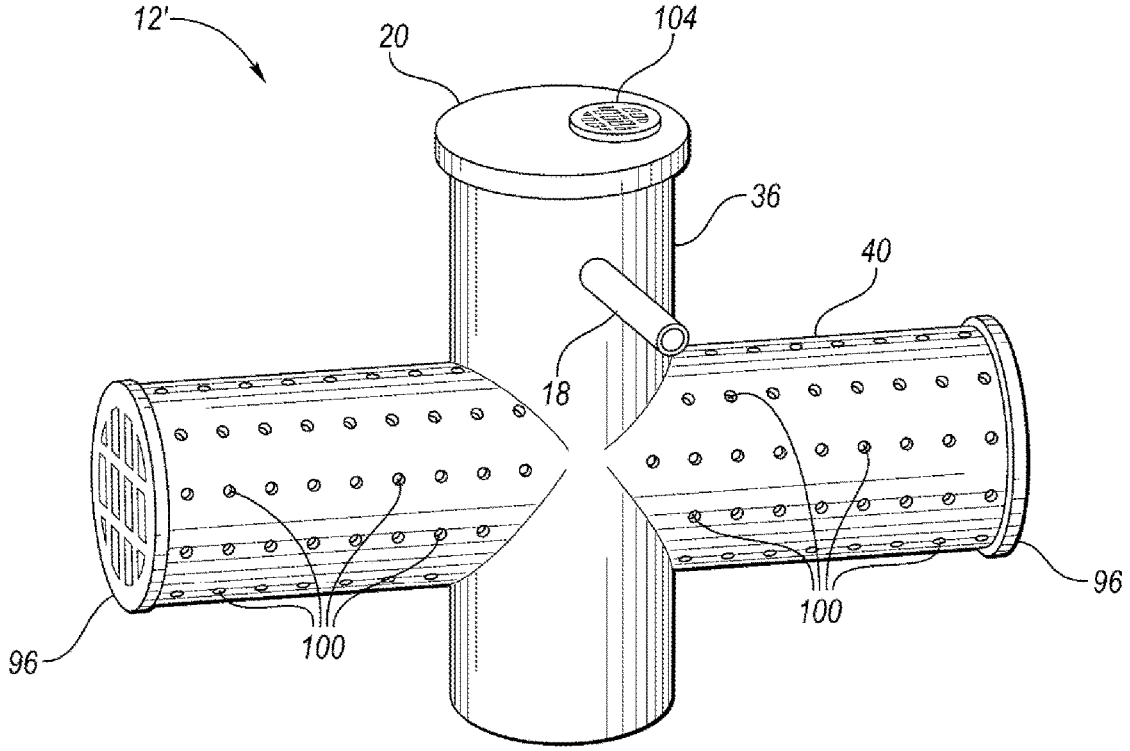
FIG. 3 is an isometric view of an alternative embodiment of the catch basin.

Referring to FIG. 3, an alternative embodiment of the catch basin 12' is illustrated. The alternative embodiment of the catch basin 12' is similar to catch basin 12. The alternative embodiment of the catch basin 12', however does not include the second vertically ending tube 38 that defines the second vertical chamber 24.

It should be understood that the designations of first, second, third, fourth, etc. for regions, directions, chambers, tubes, sump pumps, or any other component, state, or condition described herein may be rearranged in the claims so that they are in chronological order with respect to the claims.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A sump system comprising:

a catch basin configured to receive runoff water, the catch basin defining a vertical chamber extending downward in a vertical direction from an upper end to a lower end, and a horizontal chamber intersecting the vertical chamber to form an intersecting region, wherein the horizontal chamber extends outwardly in first and second opposing horizontal directions from an outer periphery of the vertical chamber such that the horizontal chamber forms first and second regions on opposing sides of the outer periphery of the vertical chamber, and wherein the vertical chamber extends outwardly in first and second opposing vertical directions from an outer periphery of the horizontal chamber such that the vertical chamber forms a third region between the upper end and a top side of the outer periphery of the horizontal chamber and such that the vertical chamber forms a fourth region between the lower end and a bottom side of the outer periphery of the horizontal chamber; and a sump pump at least partially disposed within the fourth region.

2. The sump system of claim 1, wherein the catch basin further defines a second vertical chamber extending downward in the vertical direction from a second upper end to a second lower end, wherein the second vertical chamber intersects the horizontal chamber to form a second intersecting region, and wherein the second vertical chamber extends outwardly in the first and second opposing vertical directions from the outer periphery of the horizontal chamber such that the second vertical chamber forms a fifth region between the second upper end and the outer periphery of the horizontal chamber and such that the vertical chamber forms a sixth region between the second lower end and the outer periphery of the horizontal chamber.

3. The sump system of claim 2 further comprising a second sump pump at least partially disposed within the sixth region.

4. The sump system of claim 1, wherein the catch basin defines a plurality of orifices along the outer periphery of the horizontal chamber that establish fluid communication between the horizontal chamber and an exterior of the catch basin.

5. The sump system of claim 1 further comprising a cap disposed over the upper end of the vertical chamber.

6. The sump system of claim 5, wherein the cap defines a porthole.

7. The sump system of claim 6 further comprising a perforated lid disposed over the porthole.

8. A sump system comprising:

a catch basin configured to receive runoff water, the catch basin defining a vertical chamber extending downward, and a horizontal chamber intersecting the vertical chamber to form an intersecting region, the horizontal chamber extending outwardly in first and second horizontal directions from the vertical chamber such that the horizontal chamber forms first and second regions on first and second horizontal sides the intersecting region, respectively, and the vertical chamber extending downward in a vertical direction from the horizontal chamber such that the vertical chamber forms a third region on a bottom side of the intersecting region; and a sump pump at least partially disposed within the third region.

9. The sump system of claim 8, wherein the catch basin further defines a second vertical chamber spaced apart from the vertical chamber, intersecting the horizontal chamber to form a second intersecting region, the second vertical chamber extending downward in the vertical direction from the horizontal chamber such that the second vertical chamber forms a fourth region on a bottom side of the second intersecting region.

10. The sump system of claim 9 further comprising a second sump pump at least partially disposed within the fourth region.

11. The sump system of claim 9, wherein the catch basin defines a plurality of orifices along an outer periphery of the horizontal chamber that establish fluid communication between the horizontal chamber and an exterior of the catch basin.

12. The sump system of claim 9 further comprising a cap disposed over an upper end of the vertical chamber.

13. The sump system of claim 12, wherein the cap defines a porthole.

14. The sump system of claim 13 further comprising a perforated lid disposed over the porthole.

15. A sump system comprising:

a catch basin configured to receive runoff water, the catch basin defining a horizontal chamber extending between first and second horizontal ends, the horizontal chamber having a ceiling and a first floor, a first vertical chamber intersecting the horizontal chamber between the first and second horizontal ends to form a first intersecting region, the first vertical chamber having a second floor that is disposed below the first floor, and a second vertical chamber intersecting the horizontal chamber between the first and second horizontal ends to form a second intersecting region, the second vertical chamber being spaced apart from the first vertical chamber and having a third floor that is disposed below the first floor; and a sump pump disposed within the first vertical chamber at least partially between the first floor and the second floor.

16. The sump system of claim 15 further comprising a second sump pump disposed within the second vertical chamber at least partially between the first floor and the third floor.

17. The sump system of claim 15, wherein the first vertical chamber extends upward from the first intersecting region to a cap that is disposed over an upper end of the first vertical chamber.

18. The sump system of claim 17, wherein the second vertical chamber extends upward from the second intersecting region to a second cap that is disposed over an upper end of the second vertical chamber.

19. The sump system of claim 17, wherein the cap defines a porthole.

20. The sump system of claim 19 further comprising a perforated lid disposed over the porthole.

* * * * *